US006615984B2

(12) United States Patent
Saulas et al.

(10) Patent No.: US 6,615,984 B2
(45) Date of Patent: Sep. 9, 2003

(54) ARTICLE CARRIER AND BLANK THEREFOR

(75) Inventors: Alain Saulas, Chateauroux (FR); Jean-Michel Garnier, Issoudun (FR)

(73) Assignee: MeadWestvaco Packaging Systems, LLC, Stamford, CT (US)

( * ) Notice: Subject to any disclaimer, the term of this patent is extended or adjusted under 35 U.S.C. 154(b) by 0 days.

(21) Appl. No.: 10/106,919

(22) Filed: Mar. 25, 2002

(65) Prior Publication Data

US 2003/0006150 A1 Jan. 9, 2003

Related U.S. Application Data

(63) Continuation of application No. PCT/US00/25606, filed on Sep. 19, 2000.

(30) Foreign Application Priority Data

Sep. 24, 1999 (GB) ..... 9922608

(51) Int. Cl.[7] ..... B65D 71/40
(52) U.S. Cl. ..... 206/427
(58) Field of Search ..... 206/139, 145, 206/147, 153, 158, 194, 196, 199, 427, 446, 526; 294/87.2

(56) References Cited

U.S. PATENT DOCUMENTS

| | | | | | |
|---|---|---|---|---|---|
| 3,528,697 | A | * | 9/1970 | Wood | 206/158 |
| 3,780,906 | A | * | 12/1973 | Katzenmeyer | 206/194 |
| 4,244,617 | A | * | 1/1981 | Manizza | 206/153 |
| 4,318,476 | A | | 3/1982 | Wood et al. | 206/459 |
| 5,344,006 | A | * | 9/1994 | Mazzeo | 206/153 |
| 5,351,815 | A | | 10/1994 | Fogle et al. | 206/153 |
| 5,351,816 | A | | 10/1994 | Sutherland et al. | 206/153 |
| 5,667,070 | A | * | 9/1997 | Miret | 206/153 |
| 5,820,185 | A | * | 10/1998 | Gomes | 206/147 |

FOREIGN PATENT DOCUMENTS

EP 0 780 323 A1 6/1997

* cited by examiner

*Primary Examiner*—Jim Foster
(74) *Attorney, Agent, or Firm*—Tsugihiko Suzuki

(57) ABSTRACT

An article carrier and a blank for forming an article carrier for holding a plurality of articles, for example bottles. The carrier comprises a plurality of wall panels for forming a tubular structure. The wall panels include a pair of side wall panels, one of which is provided with a reinforcing tab hingedly connected thereto along an article-retaining edge of a first aperture for receiving an article. The reinforcing tab is folded to underlie the one side wall panel to provide a two-ply structure adjacent the article-retaining edge.

11 Claims, 4 Drawing Sheets

ARTICLE CARRIER AND BLANK THEREFOR

This is a continuation of international application No. PCT/US00/25606, filed Sep. 19, 2000, which is hereby incorporated by reference.

BACKGROUND OF THE INVENTION

The invention relates to a carrier produced for packaging a plurality of articles, for example bottles. More particularly, the invention relates to an article carrier of the top-gripping type which is attached to the tops of the articles thereby securing the articles in an array. The invention also relates to a bottle package formed using the carrier.

It is known to provide top-gripping carriers designed to engage bottle neck flanges by so called "sunburst" apertures having a series of tabs which enable the bottle top to pass through the apertures, which tabs engage the underside of the bottle top or on the flange of a bottle neck to prevent the removal of the bottle from the aperture. A problem arises when such "sunburst" type apertures are used for bottles, particularly when the location in which the tab engages the underside of the bottle top is high up on the bottle neck. This creates a carrier that is unstable because there is a tendency for undue movement between the bottle and the carrier. For example, jiggling of the bottles in the carrier while the bottles are transported, would give a sense of carton insecurity to the users and could cause panels of the carrier to warp or crease. Further, once the article is held by the carrier it can be difficult to remove the article from the carrier because the arrangement of the tabs makes it difficult to reuse the article carrier.

A further problem is that a top-gripping carton needs to be of sufficient strength to support the articles especially where the article is large or if the articles to be packaged vary in size.

SUMMARY OF THE INVENTION

The present invention and the preferred embodiments seek to overcome or at least mitigate the problems of the prior art.

Beneficially, the carrier can package a variety of article types with different shapes of necks. One advantage is that the top engaging carrier of the invention is capable of inhibiting undue movement of the bottles with respect to the carrier. Furthermore, the carrier is arranged to facilitate easy access to the articles to be removed from the carrier without causing undesired warp or creases in the side walls.

A first aspect of the invention provides an article carrier for holding a plurality of articles, for example bottles, which carrier comprises a plurality of panels including side wall panels for forming a tubular structure, one of the side wall panels having at least one severance line and a reinforcing tab hingedly connected to an edge of a first aperture for receiving the article, which reinforcing tab is folded to underlie the one side wall panel.

Optionally, there further comprises a second aperture struck from a base panel in spaced alignment with the first aperture and wherein the reinforcing tab has a pull tab joined thereto and extending downwardly and outwardly through the second aperture.

In another optional feature, the reinforcing tab is struck from said one of the side wall panels.

According to another feature there further comprises an article engaging flap struck from the second aperture, which article engaging flap is disposed in engagement with the pull tab to retain the reinforcing tab in the folded underlying position.

According to another optional feature there further comprises securing means for securing together adjacent panels to maintain the tubular structure, wherein the securing means may comprise a securing tab hingedly connected to one of the adjacent panels and adapted to be engaged to be engaged with the article engaging flap to retain the securing tab in a folded underlying position within the tubular structure.

Preferably, there further comprises a second severance line so constructed and arranged with respect to the first severance line as to define a tear strip between the first and second apertures. More preferably, the reinforcing tab is hingedly connected to the tear strip.

A second aspect of the invention provides a blank for forming an article carrier which blank comprises a plurality of panels including side wall panels for forming a tubular structure, one of the side wall panels having at least one severance line and a reinforcing tab hingedly connected to an edge of a first aperture for receiving the article to be disposed within the first aperture.

According to an optional feature of the second aspect of the invention there may further comprise a second aperture struck from a base panel adapted to be placed in spaced alignment with the first aperture in a set up condition and wherein the reinforcing tab has a pull tab joined. Preferably, the reinforcing tab is struck from said one of the side wall panels.

According to another optional feature of the second aspect of the invention there may further comprise a second severance line so constructed and arranged with respect to the first severance line as to define a tear strip between the first and second apertures. Optionally, the reinforcing tab is hingedly connected to the tear strip.

BRIEF DESCRIPTION OF THE DRAWINGS

Exemplary embodiments of the invention will now be described, by way of example only, in which:—

DETAILED DESCRIPTION OF THE PREFERRED EMBODIMENT

Figure 1:
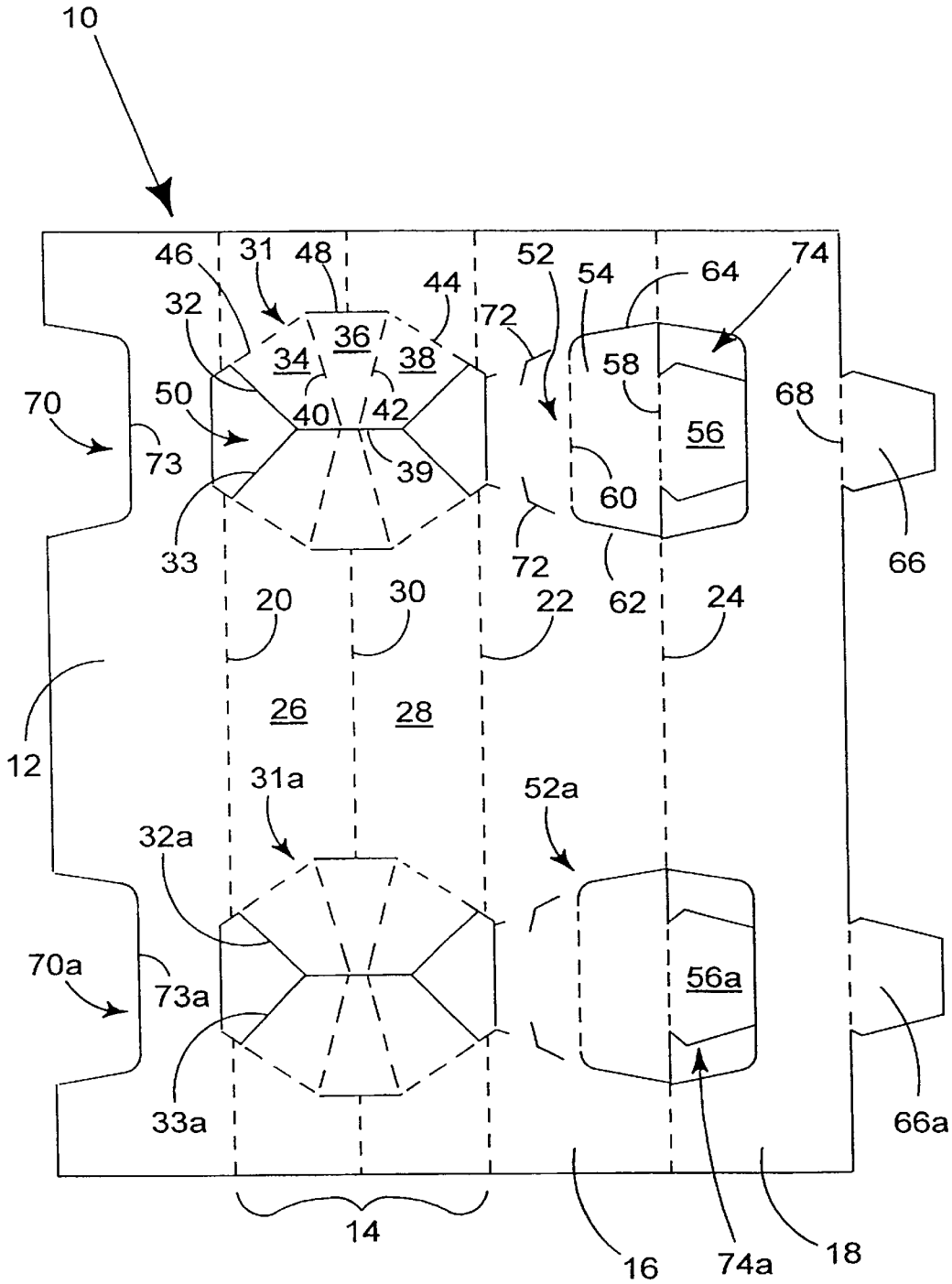
FIG. 1 is a plan view of a carton blank for forming a carton according to one embodiment of the invention.
Figure 2:
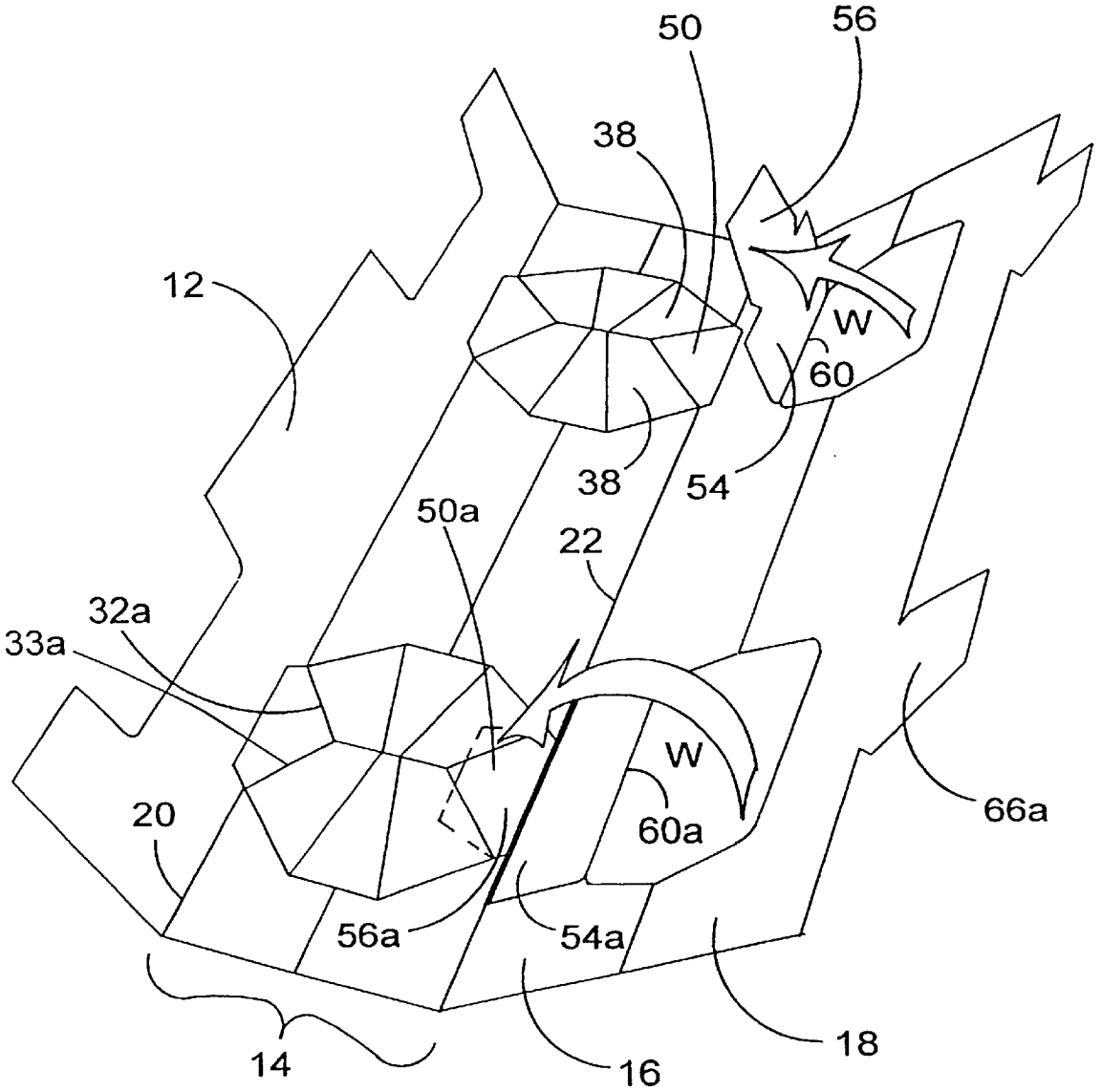
FIG. 2 is a perspective view of the carton blank shown in FIG. 1 during construction.

Referring to the drawings and in particular FIG. 1 thereof, there is shown a blank for forming an article carrier for accommodating a plurality of articles, for example bottles, made from paperboard or similar foldable sheet material. The blank 10 comprises an inner first side wall panel 12, a base wall 14, second side wall panel 16 and outer first side wall panel 18 hingedly connected one to the next along fold lines 20, 22 and 24. The base wall panel 14 may include a medial fold line 30 extending longitudinally along the length of the base panel 14, for the reasons outlined below, so as to divide the base panel into two parts 26 and 28 respectively.

The base wall 14 further comprises one or more article receiving and retaining means 31, 31*a* which includes a plurality of retention tabs 32, 33, 32*a*, 33*a* hingedly connected to the base wall 14. The retention tabs define, in part, an article-receiving aperture 50 for receiving an upper portion of an article A engaged by the carrier. Turning in detail to the preferred configuration of one of the retention tabs 32, there comprises a plurality of panels hingedly connected together to configure the panels of the tab in an angular relationship thereby to strengthen it. In this embodiment, three panels 34, 36, 38 are provided and are hingedly connected together along fold lines 40 and 42 to cause the panels of the erected tab to be placed in two or more planes. Preferably, fold lines 40 and 42 diverge from the free engaging edge of tab 32, so that the panels 34, 36, 38 are placed in three different planes.

In this embodiment, retention panels 34 and 38 are hingedly connected to base wall 14 along fold lines 44 and 46 respectively, which fold lines may also diverge for the reasons given in the preceding paragraph. Panel 36 is, optionally, separated from the base wall 14 by cut line 48 extending between the ends of fold lines 44 and 46. Preferably, cut line 48 bisects fold line 30. The tab 32 is provided with an article retaining edge 39 which extends along the free edge of one or more of panels 34, 36 and 38. A second tab 33 may be provided which is substantially identical to retaining tab 32 and therefore not described in any greater detail. In this embodiment tab 33 is formed along the opposing side of aperture 50. It will be seen from FIG. 1 that the retaining edges 39 of each tab 32, 33 about.

Figure 3:
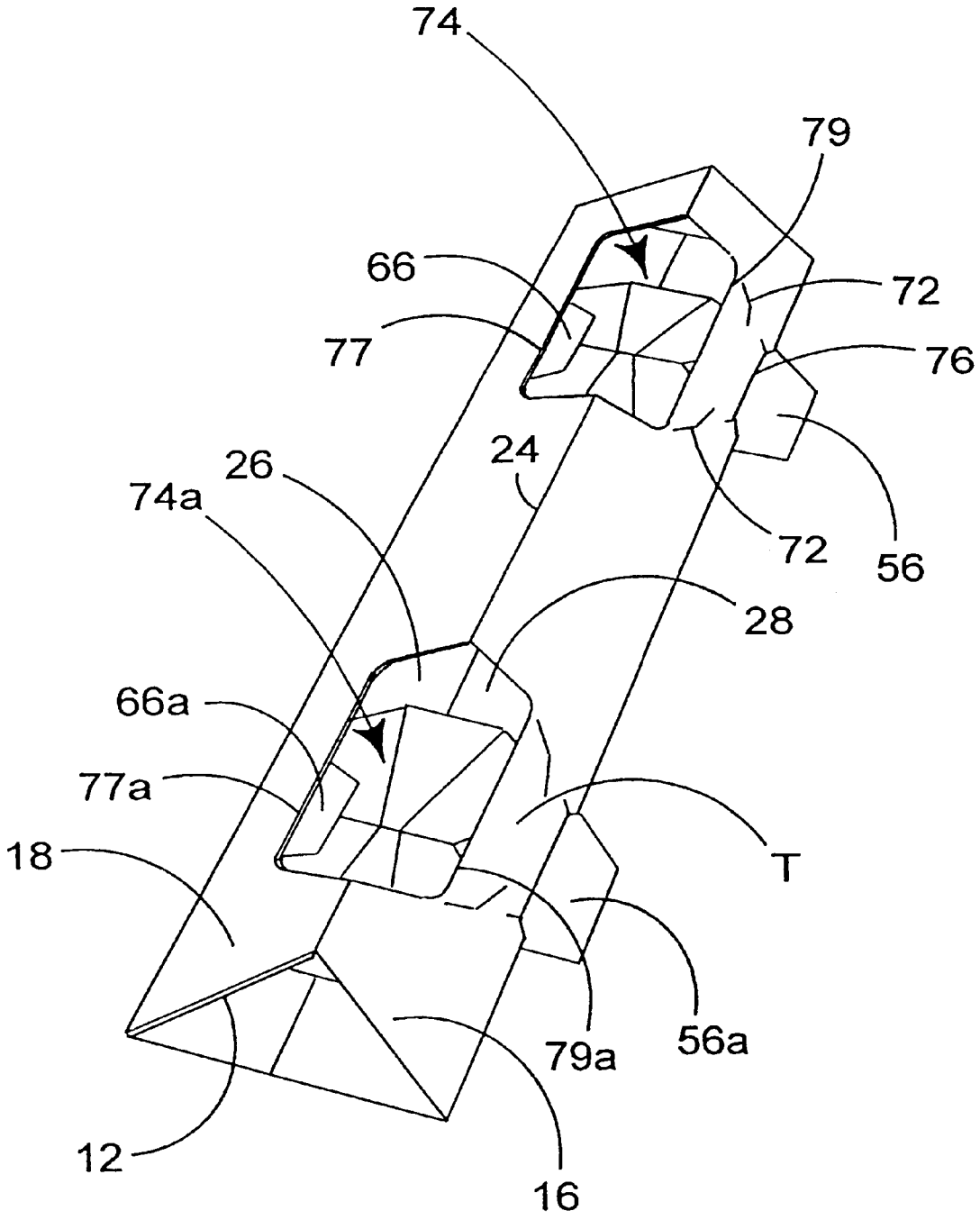
FIG. 3 is a perspective view of the carton formed from the blank of FIG. 1.

There further comprises a second article receiving aperture 74 formed from the side wall panels 12/18 and 16, which apertures can be seen clearly from FIG. 3. The aperture 74 is positioned on the side walls to be substantially aligned vertically with aperture 50 when the carton is in a set up condition, and to bisect the upper edge of the carrier, in this embodiment. Aperture 74 comprises a pair of opposed retaining edges 77, 79 (FIG. 3) formed from first and second side wall panels respectively.

There further comprises a reinforcing tab 54 hingedly connected to one of the side wall panels which in this embodiment, extends into aperture 74. Reinforcing tab 54 is hingedly connected along one edge to second side wall panel 16 by fold line 60 and is separated from the second side wall panel by opposed cut lines 62, 64. There may further comprise a pull tab 56 hingedly connected to the reinforcing tab 54 along fold line 58, whereby the pull tab is adapted to extend downwardly and outwardly beyond the carton in a set up condition. A tear strip 52 is provided between apertures 50 and 74 whereby cut lines or frangible lines 72 are provided to aid tearing during use.

There may further comprise securing tab 66 hingedly connected to outer first side wall panel 18 along fold line 68 which is used to secure the carton into a set up condition.

It will be seen from FIG. 1 that a recessed portion 70 is provided on inner first side wall panel 12 that is aligned with and conforms to the shape of the aperture 74 formed from adjacent outer side wall panel 18. The recess 70 is provided with an article engaging edge 78 which in use is aligned with the article engaging edge 73.

The invention is not limited to one article receiving and retaining means. In fact there may further comprise two or more article receiving and engaging means in the carrier depending upon the number of articles to be carried. In this embodiment, there comprises a second-article engaging means and reinforcing tab structure which is substantially the same as those features described above so are not described in any more detail. The same reference numerals are used to designate corresponding elements with the addition of the letter "a".

Turning to the construction of the carrier by reference to FIGS. 2, 3, 4 and 5 the blank 10 requires a series of sequential folding operations to form the carrier which can be formed in a straight line machine so that the carrier is not required to be rotated or inverted to complete its construction. The folding process is not limited to that described below and can be altered according to particular manufacturing requirements.

The first stage of construction is for the carton to be formed into a tubular structure. This is achieved by folding inner first side wall panel 12 about fold line 20 and second side wall panel 16 and outer first side wall panel 18 about fold line 22. During this first stage in the folding process, retention tabs 54 and 54*a* are folded about fold line 60 and 60*a* respectively in direction W to cause pull tabs 56 and 56*a* to pass through aperture 50. The retention tabs 54 and 54*a* are held in place by abutment between the pull tab 56 and the adjacent panels 38 forming the article retention tab 32 and 33 and/or panel 28.

In one class of embodiments, the pull tab is shaped to define a neck and shoulder portion; the neck portion is preferably at the base of the tab and is reduced width relative the shoulder portions. Thus, it is the shoulder portions that abut the base panel 28. Beneficially, the retention tabs provide a two ply structure for additional support at a weaker part of the side walls, by the severance line or tear strip.

Figure 4:
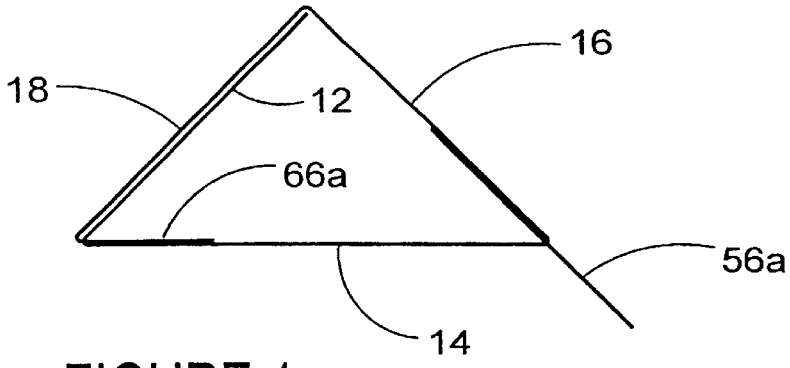
FIG. 4 is an end elevation view of the carton shown in FIG. 3.

Thereafter, the second side wall panel 16 and outer first side wall panel 18 are folded out of alignment about fold line 24 such that panels 12 and 18 are placed in a face contacting relationship, as shown in FIG. 3 to form a tubular structure. The structure is maintained by suitable securing means. In this embodiment, securing tabs 66 and 66*a* are folded upwardly about fold lines 68 and 68*a* respectively to pass through aperture 50, 50*a* within the tubular structure. Securing tabs 66, 66*a* are held in place by abutment between their lower edges and-the base wall panel 26 in a similar manner to the pull tabs 56. Thus the carton is in a set up condition as shown in FIGS. 3 and 4.

The carton is then ready for final loading. The articles are grouped together in a row, for example 1×2, and the erected carrier is introduced to a group from above by relative vertical guide means between the bottles and the carton preferably during forward feed as is well known in the art.

Figure 5:
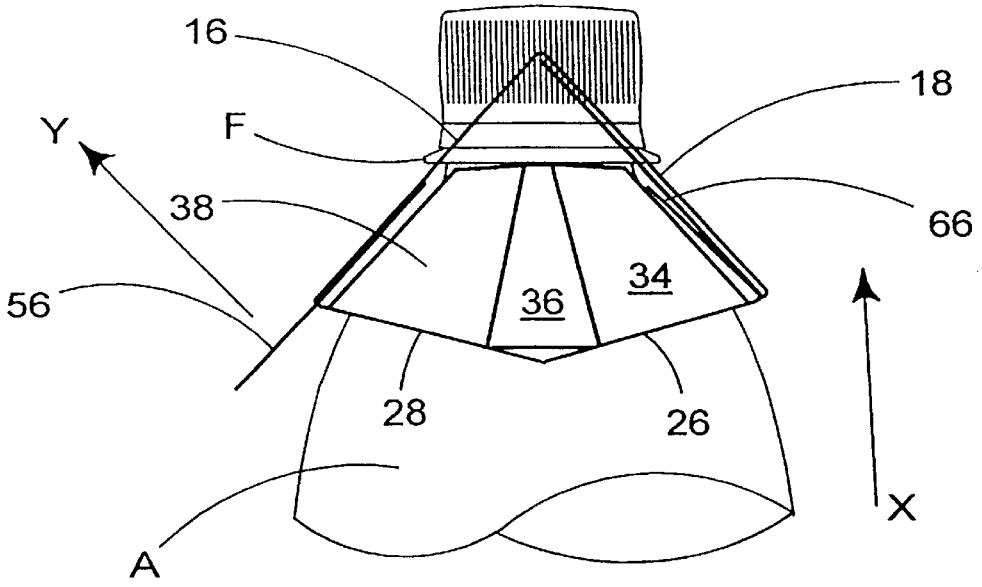
FIG. 5 is an elevational view of the opposing end of the carton shown in FIG. 4 in a set up and loaded condition.

The articles A are inserted into apertures 50 in the base panel and retaining tabs 32 and 33 are moved out of alignment with base panel 18, shown in FIG. 5. As the articles progress through the carrier in direction X, the retaining panels 34, 36 and 38 are folded out of alignment about fold lines 40 and 42 respectively and are pushed upwardly together with the upper portion of the article. As shown in FIG. 5, the article A continues to move through aperture 50 such that the base wall is caused to be folded downwardly by the folding action of the retaining panels such that base panel portions 26 and 28 are folded out of alignment with each other to form a beam like structure to create a stronger base structure.

The retention tabs 32 and 33 are forced upwards as the article passes into upper aperture 74 to engage the article, for example the underside of a protruding portion of an article associated within each aperture 50 and 74. Furthermore, the edges of upper article receiving aperture 74 are caused to engage the protruding portion to provide additional support.

Thus the carrier is provided in a fully loaded and erected condition shown in FIG. 5.

In order to remove an article, the user pulls on the pull tab 56 in a direction Y (FIG. 5) away from the article which causes the tear strip to be separated from the second side wall 16. Once the tearing motion is completed the pull tab 56, the reinforcing tab 54 and the tear strip T can be removed from the remainder of the carrier to reveal an aperture through which the article A can pass. However the remainder of the carrier remains intact to support the or each of the other articles.

It will be recognised that as used herein directional references such as top, base, end, side, inner and outer do not limit the respective panels to such orientation but merely serve to distinguish these panels from one another. Any reference to hinged connection should not be construed as necessarily referring to a single fold line only: indeed it is envisaged that the hinged connection can be formed from one or more of the following: a score line, a frangible line or a fold line, without departing from the scope of invention.

The present invention and its preferred embodiments relate to an article carrier which is shaped to provide satisfactory strength to hold bottles securely but with a degree of flexibility so that the load transferred through the retention tabs is absorbed by the carrier. The shape of the blank minimises the amount of paperboard that would be required and the machinery can be applied to an array of bottles and/or automatic machinery. It is anticipated that the invention can be applied to a variety of carriers and is not limited to those of top-gripping type. In particular it would be possible to use the invention for wraparound or end-loaded cartons in which case, the retaining tabs and pull tabs would extend outwardly of the tubular structure to aid tearing of the carton during use.

Furthermore, it is envisaged that the invention can be applied to a carrier with a different arrangement of articles for example two rows of three articles, without departing from its scope.

What is claimed is:

1. An article carrier for holding a plurality of articles, comprising:

a plurality of wall panels including a pair of side wall panels for forming a tubular structure, one of said side wall panels having a first aperture struck therefrom for receiving and retaining an article; and a reinforcing tab hingedly connected to said one side wall panel along an article-retaining edge of said first aperture so that said retaining edge is brought into abutment with the article in said first aperture, said reinforcing tab being folded inwardly of said carrier to take a folded position where said reinforcing tab underlies said one side wall panel to provide a two-ply structure adjacent said article-retaining edge, wherein said wall panels further includes a base panel having a second aperture struck therefrom, said second aperture being in spaced alignment with said first aperture, and wherein said reinforcing tab has a pull tab joined thereto and extending downwardly and outwardly through said second aperture.

2. The article carrier as claimed in claim 1 wherein said first aperture extends into the other side wall panel, and said reinforcing tab is struck from said one side wall panel.

3. The article carrier as claimed in claim 1 further comprising an article engaging flap struck from said base panel and defining at least part of said second aperture, said article engaging flap being disposed in engagement with said pull tab to retain said reinforcing tab in said folded position.

4. The article carrier as claimed in any of claim 3 further comprising securing means for securing the other side wall panel to said base panel to maintain said tubular structure, and said securing means comprising a securing tab hingedly connected to said other side wall panel and engaged with said article engaging flap to retain said securing tab in a folded position within said tubular structure.

5. The article carrier as claimed in claim 1 wherein said one side wall panel is formed with a pair of severance lines each extending between said first and second apertures to define a tear strip between said severance lines.

6. The article carrier as claimed in claim 5 wherein said reinforcing tab underlies said tear strip.

7. The article carrier as claimed in claim 5 wherein said reinforcing tab is hingedly connected to said tear strip.

8. A blank for forming an article carrier for holding a plurality of articles, said blank comprising a plurality of wall panels hingedly connected together in series, said wall panels including a first panel having a first aperture defined therein, and a reinforcing tab hingedly connected to said first panel along an article retaining edge of said first aperture, said reinforcing tab being adapted to be folded to underlie said first panel to provide a two-ply structure adjacent to said article retaining edge in a set up condition, wherein said wall panels further includes a second panel adjacent to said first panel, said first aperture extends into said second panel, and said reinforcing tab is struck from said first panel, wherein said wall panels further comprises a third panel adjacent to said first panel and having a second aperture struck therefrom, said second aperture being adapted to be placed in spaced alignment with said first aperture in a set up condition, and wherein the reinforcing tab has a pull tab joined thereto.

9. The blank as claimed in claim 8 further comprising an article engaging flap struck from said third panel and defining at least part of said second aperture, said article retaining tab being adapted to be disposed in engagement with said pull tab to retain said reinforcing tab in a folded position in a set up condition.

10. The blank as claimed in claim 8 wherein said first panel is formed with a pair of severance lines each extending between said first and second apertures to define a tear strip between said severance lines.

11. The blank as claimed in claim 10 wherein said reinforcing tab is hingedly connected to said tear strip.

* * * * *